US005642143A

United States Patent [19]

Rhoads

[11] Patent Number: 5,642,143

[45] Date of Patent: Jun. 24, 1997

[54] INK-JET HARD COPY APPARATUS HAVING PRINT CARTRIDGE BIASING MECHANISM AND CARTRIDGE LOADING METHOD

[75] Inventor: W. Wistar Rhoads, Escondido, Calif.

[73] Assignee: Hewlett-Packard Company, Palo Alto, Calif.

[21] Appl. No.: 629,794

[22] Filed: Apr. 9, 1996

Related U.S. Application Data

[63] Continuation of Ser. No. 375,331, Jan. 17, 1995, abandoned, which is a continuation of Ser. No. 56,702, Apr. 30, 1993, Pat. No. 5,392,063.

[51] Int. Cl.[6] ..... B41J 2/14

[52] U.S. Cl. ..... 347/49

[58] Field of Search ..... 347/49, 50, 86, 347/87; 372/9.48, 9.52, 9.53, 9.55, 9.57, 9.63

[56] References Cited

U.S. PATENT DOCUMENTS

| | | | |
|---|---|---|---|
| 4,736,213 | 4/1988 | Piatt et al. . | |
| 4,755,836 | 7/1988 | Ta Chuong et al. . | |
| 5,138,342 | 8/1992 | Kurata et al. | 347/50 |

FOREIGN PATENT DOCUMENTS

| | | |
|---|---|---|
| 0376719 | 7/1990 | European Pat. Off. . |
| 0379151 | 7/1990 | European Pat. Off. . |
| 0467424 | 1/1992 | European Pat. Off. . |
| 0526062 | 2/1993 | European Pat. Off. . |

*Primary Examiner*—Benjamin R. Fuller
*Assistant Examiner*—Craig A. Hallacher

[57] ABSTRACT

An ink jet printer includes a movable carriage supported above an ink-receiving medium by a rail defining a carriage axis, with a cartridge holder mounted on said carriage having a plurality of cartridge compartments each receiving a respective thermal ink jet printer cartridge. A unitary latch assembly secures all four cartridges inside their respective cartridge compartments of cartridge holder. The latch assembly comprises a metallic spring and four forwardly facing latch ends separated by five respective forwardly facing supporting ends. Each latch end is connected to its two adjacent supporting ends by a serpentine arm defined by suitable radiused cutouts in the stamped spring to provide a shape that approximates a constant stress geometry. Each supporting end is terminated by a straight edge which is inserted into a corresponding slot at the upper rear of cartridge holder; because the latch assembly is a single unit, only one assembly operation is required for all four cartridge compartments. Because of the serpentine shape of the individual serpentine arm, it is possible to provide a spring that is relatively compact from front to rear and yet provides a relatively substantial constant downwards force on the top rear of the cartridge over a relatively large deflection range. Each latch end is provided with a cam preferably molded of a low friction material and shaped in the form of a horizontal section of an inclined cylinder. A lower tangential plane on the cylindrical surface intersects the plane of the latch end at an oblique angle, thereby producing a sideways force component to maintain a datum surface on an upper side edge of the cartridge in contact with a corresponding supporting surface on an interior side wall of the cartridge holder.

11 Claims, 9 Drawing Sheets

102
98
104
108
100
18
96
94
78
82
80
16

INK-JET HARD COPY APPARATUS HAVING PRINT CARTRIDGE BIASING MECHANISM AND CARTRIDGE LOADING METHOD

This is a continuation of U.S. application Ser. No. 08/375,331, filed on Jan. 17, 1995, abandoned Apr. 9, 1996, which is a continuation of U.S. application Ser. No. 08/056,702, filed Apr. 30, 1993, and now U.S. Pat. No. 5,392,063.

TECHNICAL FIELD

The present invention relates generally to inkjet printers having multiple printing cartridges each having its own nozzle assembly and ink reservoir, and more particularly to a spring clamp for ensuring accurate and stable alignment of the cartridges when installed in a printer having a multiple compartment cartridge holder.

CROSS-REFERENCE TO RELATED APPLICATIONS

The following commonly assigned U.S. patent application claims an invention which, although believed to be patentably distinguishable, may be related to the present invention:

D. W. Swanson et al, "Side Biased Datum Scheme for Inkjet Cartridge and Carriage", filed concurrently herewith (Attorney Docket HP 1093061-1).

Accordingly, that application (and the patents and patent applications referenced therein) are hereby incorporated by reference.

BACKGROUND ART

From U.S. Pat. No. 4,755,836 it is known to provide an inkjet printer with a pair of replaceable printing cartridges (each having at least one nozzle assembly and associated ink reservoir) mounted on a common carriage, and to maintain registration between the cartridges and the carriage by means of alignment and registration features such as protuberances, shims, opening and surfaces. A separate latch mechanism is provided for each cartridge which provides a loading force in all three coordinate axes and cooperates with the registration and alignment features to prevent pitch, yaw and roll of the cartridge.

From U.S. Pat. No. 4,872,026 it is known to facilitate the installation of a single inkjet cartridge by providing a lower pivot below an electrical interface, adjacent the intersection of the contact and nozzle planes, with the single cartridge being held in its installed position by an appropriately shaped upper latch spring.

SUMMARY OF THE INVENTION

In its basic aspects, the present invention provides an ink-jet hard copy apparatus for applying ink to media passing through a print zone of said apparatus using at least one, media scanning, print cartridge which carries a printhead on a region of the print cartridge proximate the print zone. A carriage has a compartment for holding the print cartridge, said print cartridge having a carriage scan X axis, a media advance Y axis, and an ink jetting direction Z axis. A latching device is provided on the carriage for engaging a distal region of the print cartridge to provide a positional bias to the print cartridge in the X, Y and Z axes. A biasing member on the carriage and separate from the latching device, abuts a proximate region side portion of the print cartridge to provide a positional bias to the print cartridge in the X axis.

In another basic aspect, the present invention provides a method of installing at least one print cartridge in an ink-jet hard copy apparatus media scanning carriage, wherein a printhead is carried on a region of the print cartridge for applying ink to media passing through a print zone of the apparatus, comprising the steps of: inserting the print cartridge into a compartment of the carriage to position the printhead adjacent to the print zone; during the inserting step, contacting a side region of the print cartridge proximate the printhead with a first spring member to bias the print cartridge in a carriage scan direction; and an end of the print cartridge distal of said printhead region forwardly to contact the cartridge with a latching device, the moving step occurring after the inserting step and after the contacting step.

BRIEF DESCRIPTION OF THE DRAWINGS

Other objects and features of the present invention will be apparent from the following description of a presently preferred embodiment taken in connection with the accompanying drawings, in which:

FIGS. 2A, 2B, and 2C are isometric views showing one of printer "cartridges" of FIG. 1 being inserted into a corresponding slot of the cartridge holder;

FIG. 10 comprising

DETAILED DESCRIPTION OF THE PREFERRED EMBODIMENT

Figure 1:
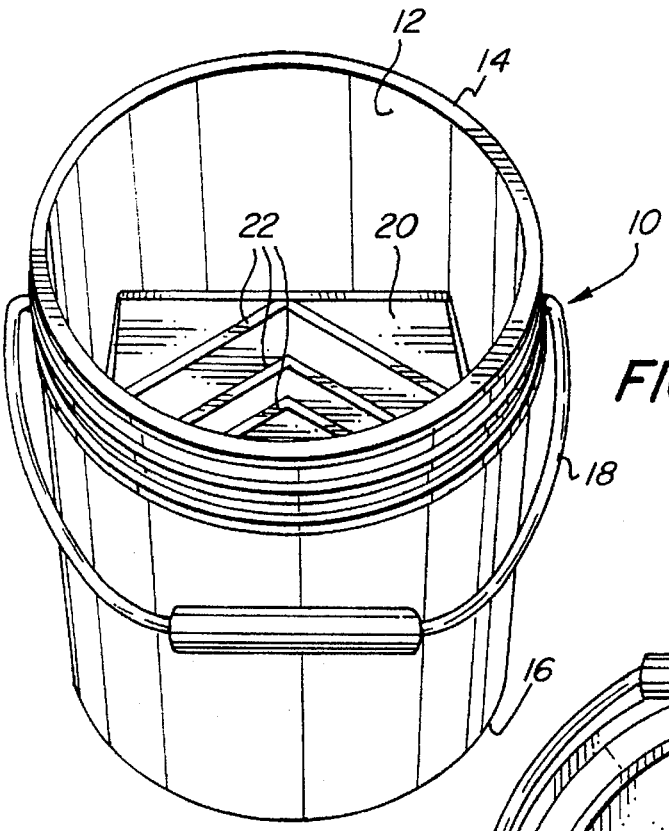
FIG. 1 is an isometric view showing the major components of an inkjet printer incorporating the present invention.
Figure 5:
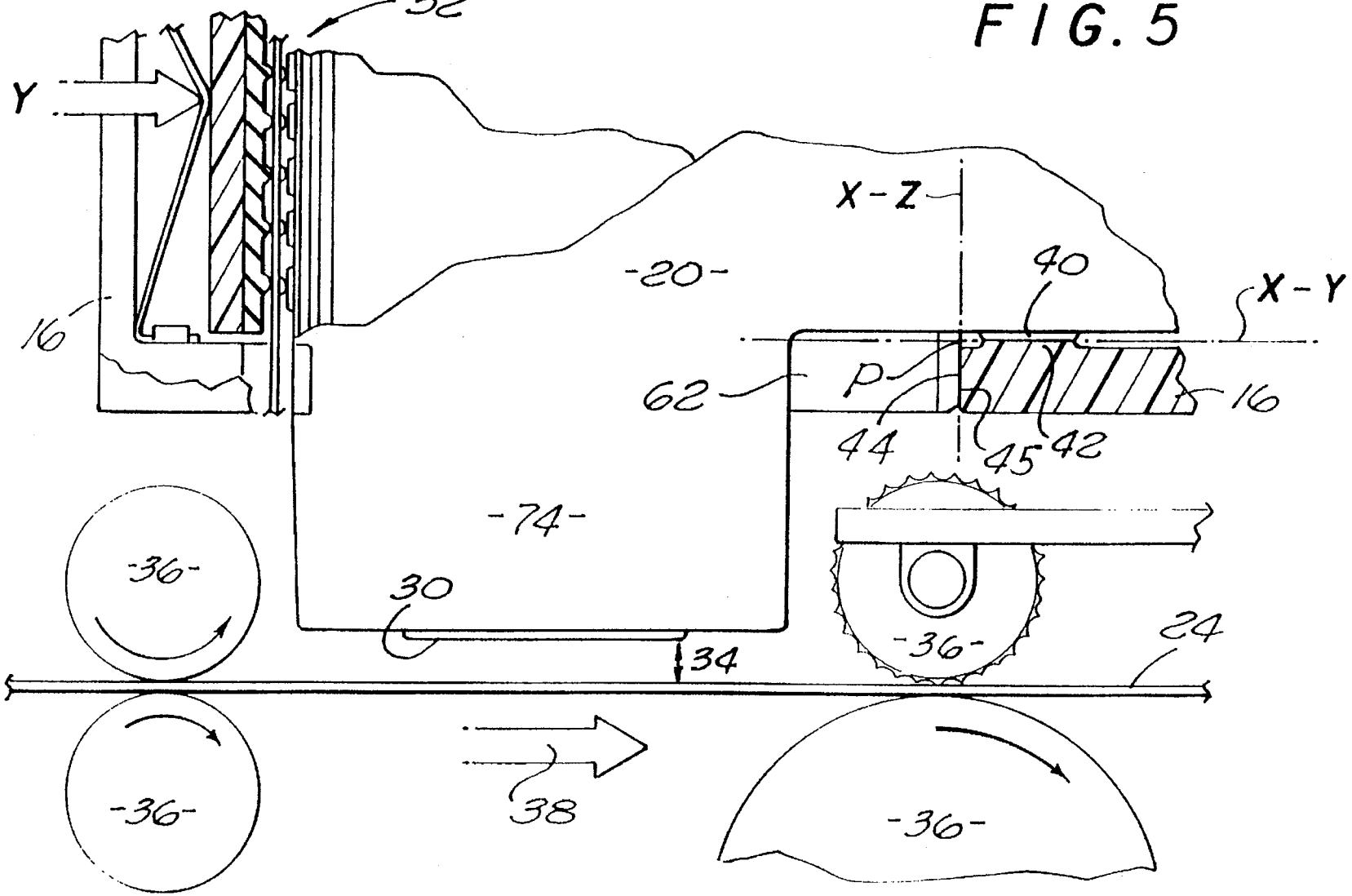
FIG. 5 is another side view, partly in cross section, showing the cartridge and a corresponding portion of the cartridge holder with their respective contacts engaged to thereby provide a registration force in the Y axis, and also showing the snout of the cartridge in its operational position relative to an advancing sheet of print media.

FIG. 1 shows a small footprint, high quality inkjet printer 10 incorporating the present invention. In particular, inkjet printer 10 includes a movable carriage 12 supported on a rail 14. As best shown in FIG. 2C, movable carriage 12 includes a cartridge holder 16 provided with a plurality of individual cartridge compartments 18 for receiving a respective plurality of thermal ink jet printer cartridges 20. Inkier printer 10 also is provided with input tray 22 containing a number of sheets of bond paper or other suitable ink-receiving medium 24, and an upper output tray 26 for receiving the printed media. As best shown in FIG. 5, each cartridge 20 is supported above the ink-receiving medium 24 by the cartridge holder 16, such that a nozzle plate 30 on lower surface 32 (FIG. 3B) is maintained an appropriate distance 34 from ink-receiving medium 24. As is conventional in inkjet printers, inkjet printer 10 is also provided with feed rollers 36 which maintain the print medium 24 in a taut condition as it passes under the nozzle plate 30, and which advance ink-receiving medium 24 in a direction 38 perpendicular to the carriage axis defined by rail 14.

Figure 2:
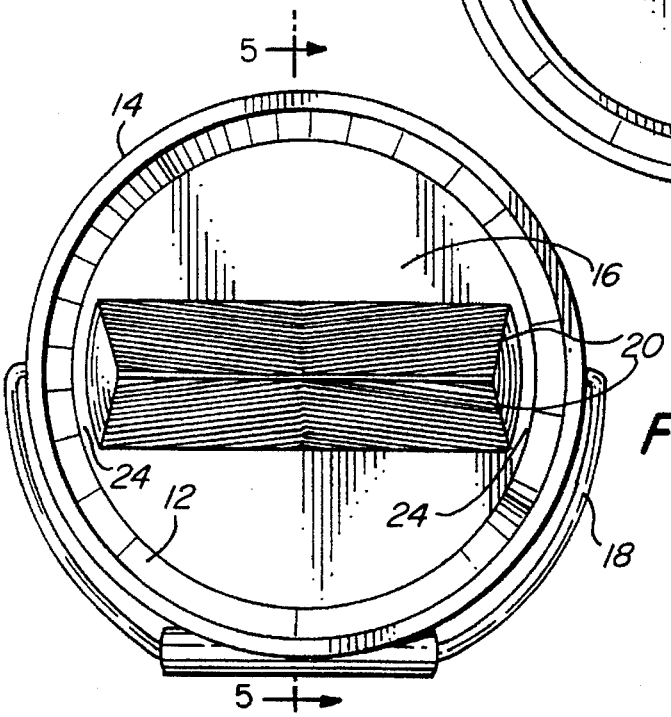
FIG. 2 comprising
Figure 2B:
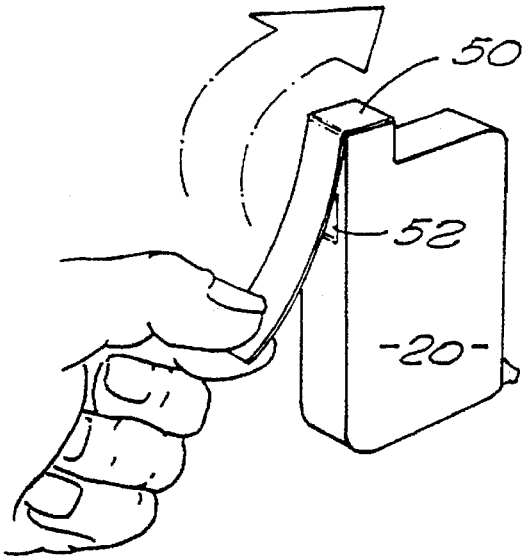
Figure 2B:
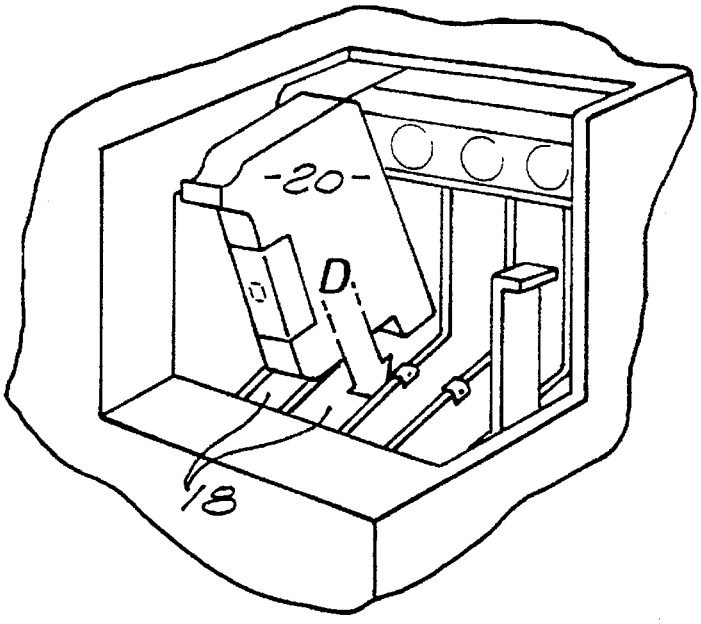
Figure 2C:
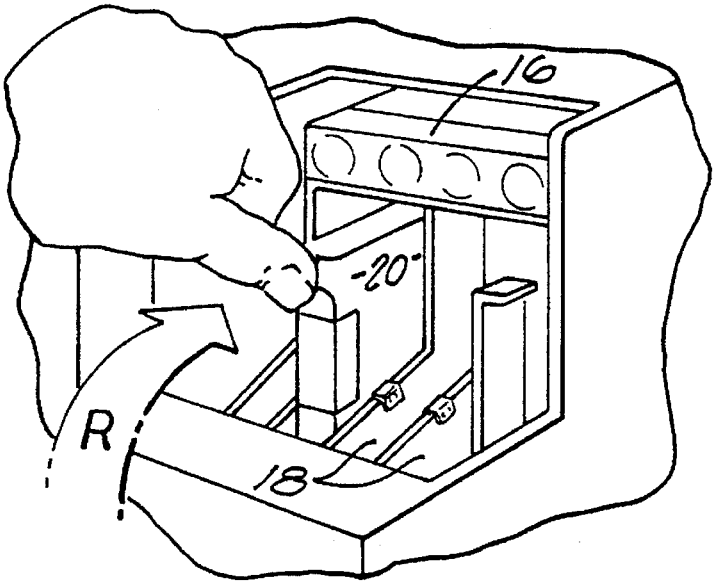

Referring now to FIG. 2, comprising FIGS. 2A, 2B, and 2C, it will be seen that cartridge 20 is installed by pushing it into its cartridge compartment 18 with a natural downward motion D until its horizontal datum surface 40 (see FIGS. 4 and 5) contacts the corresponding supporting surface 42 on the bottom of the cartridge compartment 18, and then rotating the cartridge 20 rearwardly (FIG. 2C) about a pivot point P (FIG. 5) in the vicinity of the intersection of the horizontal and vertical datum surfaces 40, 44 (FIG. 5) with a natural rearward motion R until an upper datum surface 46 (FIG. 4) contacts a corresponding supporting surface 48 on the upper rear of the cartridge compartment. As shown in FIG. 2A, cartridges 20 are preferably provided with a protective strip 50 which is removed prior to installation to expose the contact surface of an electrical interface 52 carried on rear surface of cartridges 20, as well as nozzle plate 30 (FIG. 3).

Figure 3:
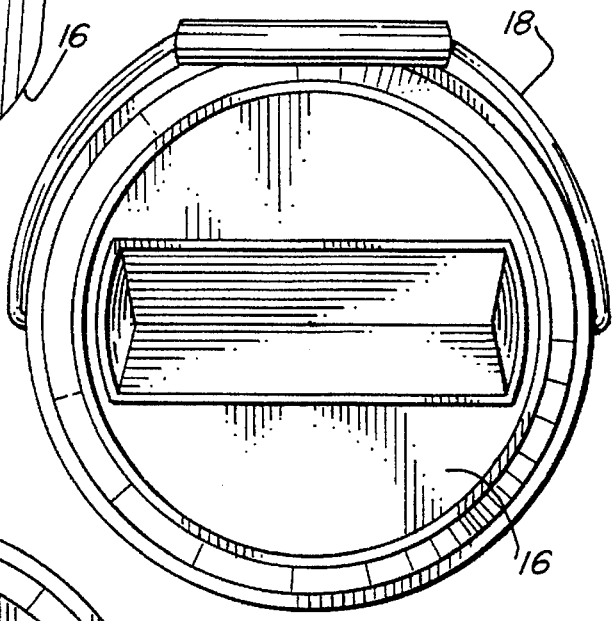
FIG. 3 comprising
Figure 3A:
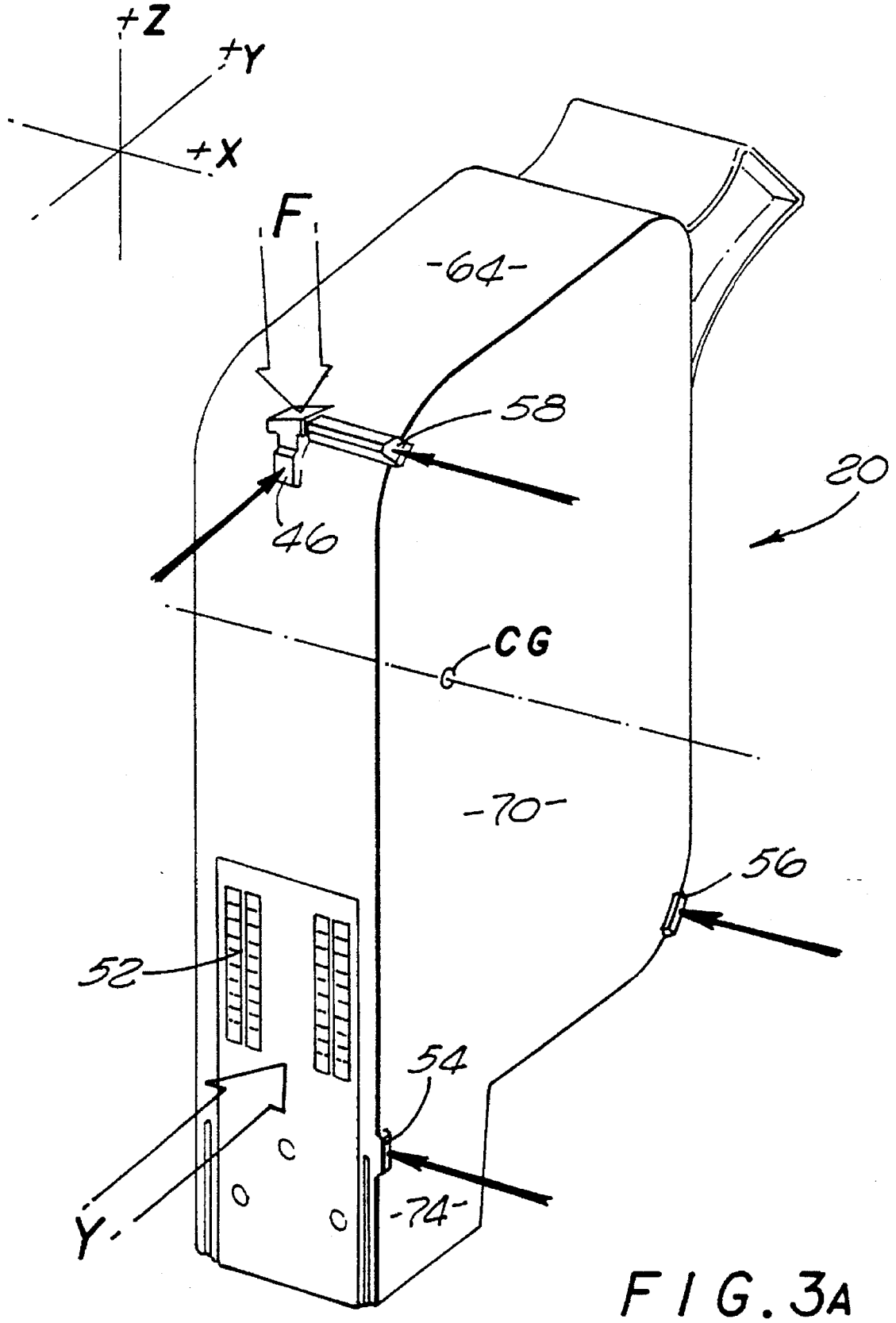
FIGS. 3A and 3B are isometric views of the cartridge of FIG. 2 as seen from the top rear and bottom front, respectively, and show the six "datum" surfaces provided in the cartridge, as well as the various registration forces which are applied to the cartridge to maintain these surfaces against corresponding registration features provided in the cartridge holder.
Figure 3B:
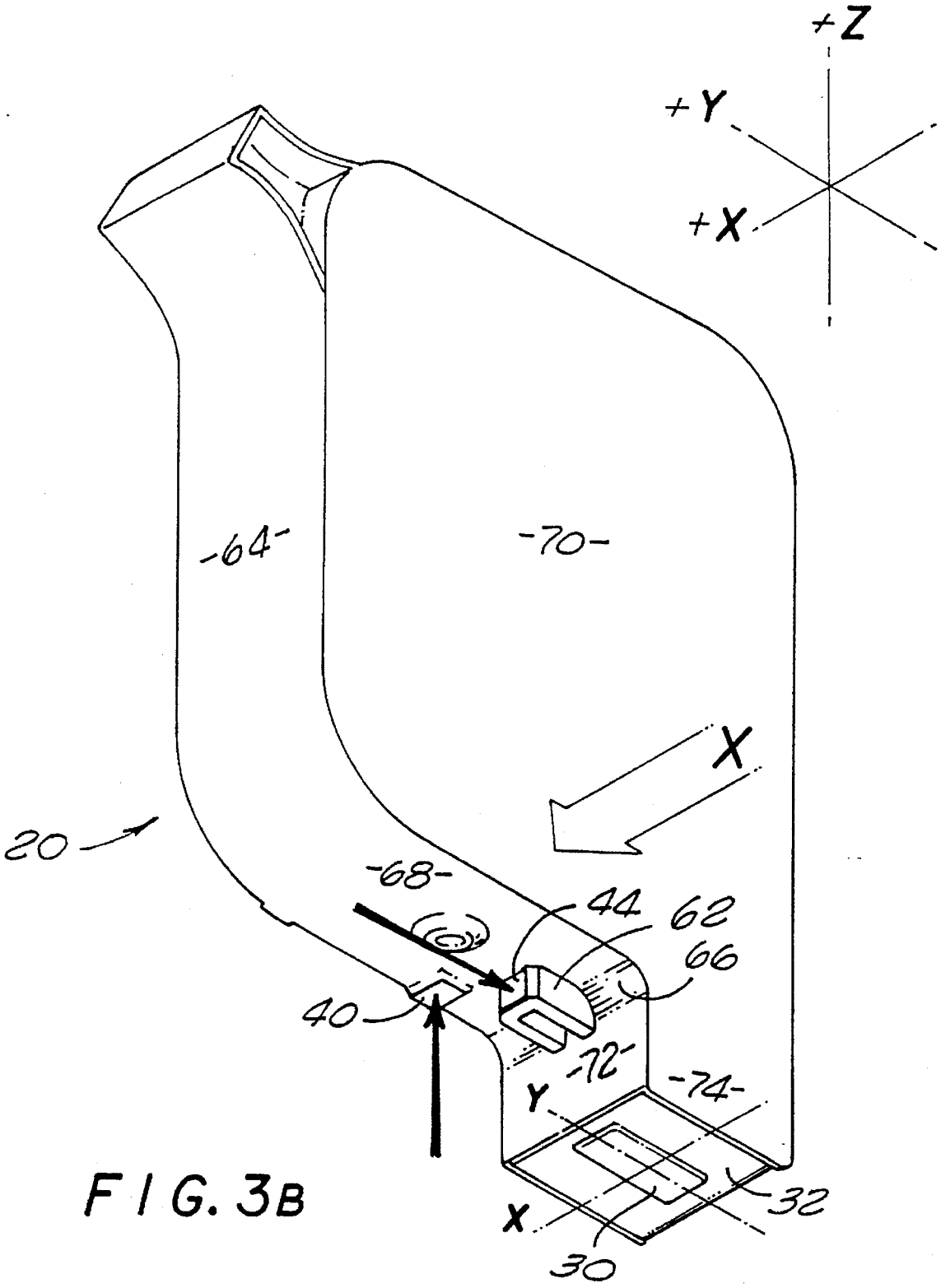
Figure 4:
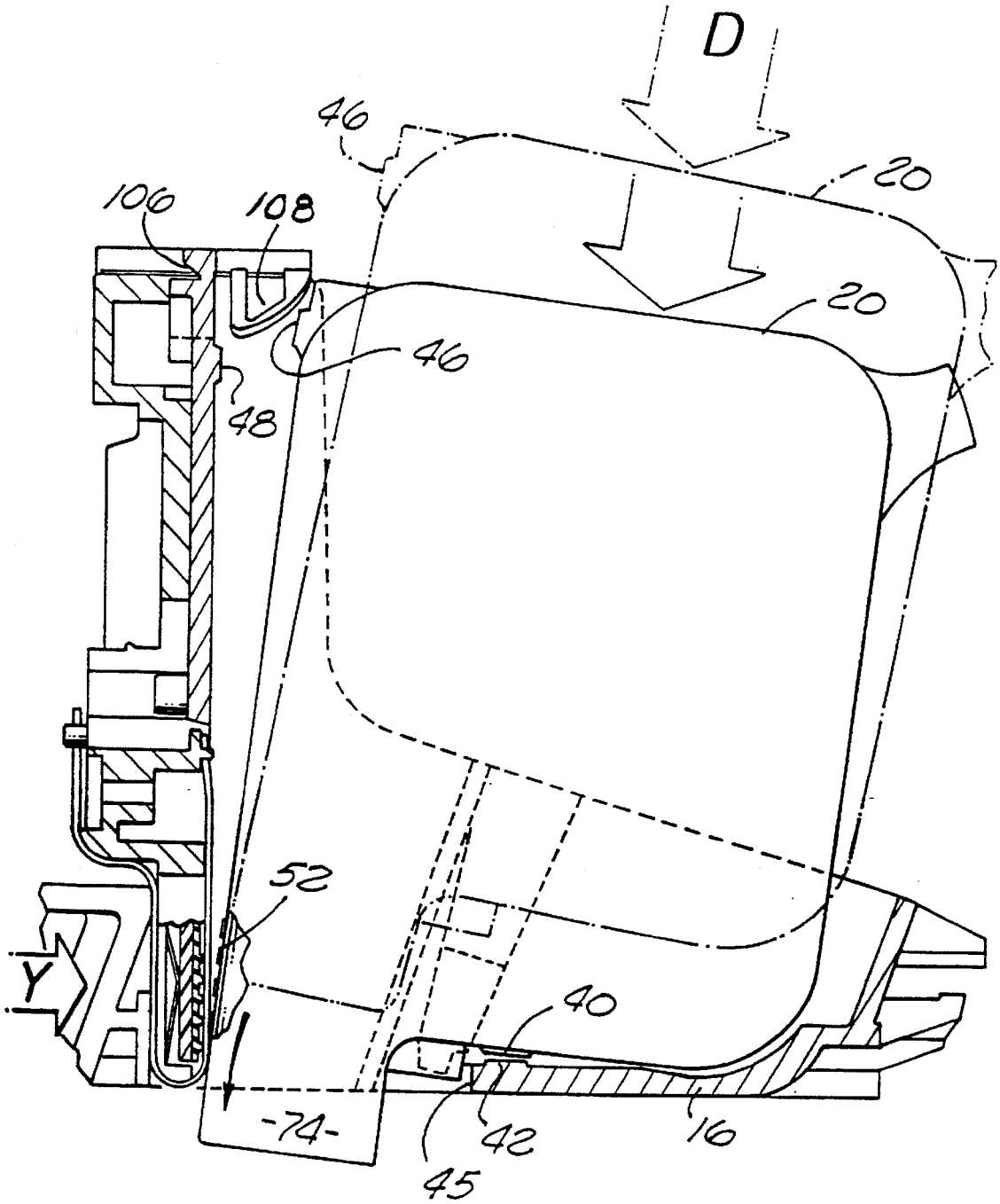
FIG. 4 is a side view, partly in cross section, of the cartridge and a corresponding portion of the cartridge holder, and illustrates the wiping action of their respective electrical contacts as the cartridge is inserted in the cartridge holder.

Reference should now be made to FIG. 3 (comprising FIGS. 3A and 3B, which are isometric views of cartridges 20 as seen from the top rear and bottom front, respectively), which shows the three side-biased "datum" surfaces provided in the cartridge in addition to the above-mentioned datum surfaces 40, 44, 46, namely, three datum surfaces 54, 56, 58 on one side of cartridge 20, which cooperate to define an Y-Z orientation plane substantially perpendicular to the nozzle plane defined by nozzle plate 30 and substantially parallel to its Y axis. It will also be noted that vertical datum surface 44 is defined on a reenforcing bracket 62 integrally formed in the perimeter wall 64 of cartridge 20 at a juncture 66 of a downwardly facing surface 68 of the ink reservoir portion 70 and a forwardly facing portion 72 of the snout portion 74.

Figure 8:
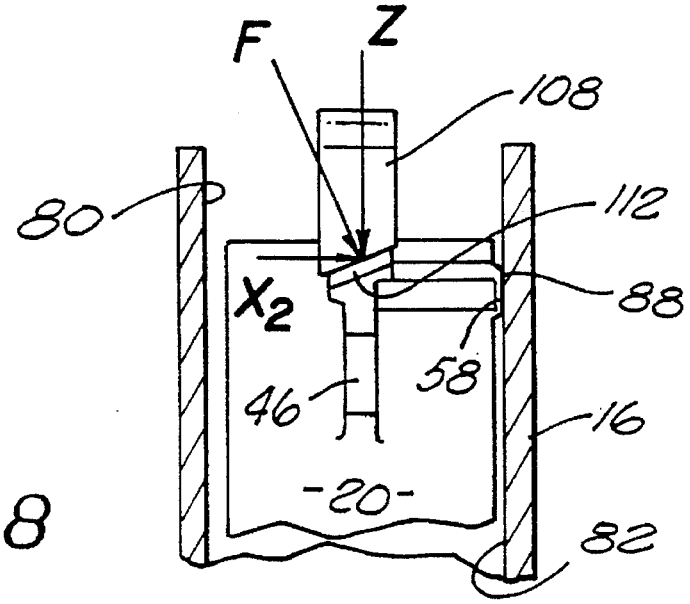
FIG. 8 is a rear view, partly in cross section, taken along line 8—8 of FIG. 7, and shows the two force components produced by the latch spring.

FIG. 3 also shows the various registration forces which when applied to the cartridge 20, serve to maintain these surfaces against corresponding registration features provided in the cartridge holder, namely a first sideways force X1 applied in the +X direction to the lower part of ink reservoir 70, a forward force Y applied in the +Y direction in the vicinity of electrical interface 52, and a third force F applied in the vicinity of upper rear datum surface 46 and upper side datum surface 58 and having a sideways component X2 in the +X direction and a downwards component Z in the −Z direction (see FIG. 8). It should be noted that the three side-biased datum surfaces 54, 56, 58 are located on the edge of the perimeter wall 64 of the cartridge 20, thereby providing additional rigidity and positional accuracy relative to the X axis, and are spaced apart from each other in the form of a triangle which surrounds the center of gravity CG of the cartridge, thereby facilitating a more accurate and stable alignment. Furthermore, since the downwards component Z of force F is offset horizontally in the +Y direction from horizontal datum surface 40 and associated supporting surface 42, the resultant counterforce from supporting surface 42 generates a net torque T which rotates cartridge 20 about pivot axis P, thereby forcing upper rear datum surface 46 into contact with sixth supporting surface 48. Because the pivot axis P (FIG. 5) is located above and in front of the snout 74, the electrical interface 52 at the lower rear of the cartridge 20 moves downwards as the cartridge is rotated rearwardly about the pivot axis P during installation, thereby producing an enhanced self-cleaning wiping action between the electrical contact surfaces on the cartridge and the cartridge holder. Moreover, even if force F has a relatively small component in the X direction, because it is at least as far above the center of gravity CG as is the center of gravity above the fulcrum defined by the two lower datum surfaces 54, 56, that relatively small force component will still suffice to prevent the cartridge from tipping sideways from an inertial force of more than twice its magnitude; in an exemplary embodiment, the mass of cartridge 20 is about 115 g and the maximum acceleration of movable carriage 12 is 1.5 g, which would require a force X2 (assuming zero friction) of about 1.75N, compared to an actual value (again assuming zero friction) of about 2.5N.

Of the various datum surfaces and their corresponding supporting surfaces, it should be understood that the most critical tolerances are associated with the two lower side-facing datum surfaces 54, 56 (which ensure that Y axes of the respective nozzle plates are parallel and accurately spaced apart) and with the lower vertical datum surface 44 (which ensures that all the X axes of the nozzle plates are aligned). In an exemplary embodiment, the cartridge 20 has a nominal height (not including snout portion 74) of 78 mm, a depth of 60 mm and a width of 19.18 mm; the nominal center-to-center spacing of the nozzle Y axes (and thus of the cartridges 20 and compartments 18) is 23.241 mm. High quality 4 color printing is obtained when each of the supporting surfaces 84, 86 is held to a tolerance of ±0.025 mm from its nominal spacing to the corresponding surface of an adjacent compartment 18 and the alignment of the three critical supporting surfaces 45, 84, 86 on cartridge holder 16 is such that they do not deviate more than ±0.0125 mm from a respective X-Z or Y-Z plane, and when the corresponding datum surfaces 44, 54, 56 of cartridge 20 do not deviate from the respective X-Z or Y-Z plane defined by the nozzle X and Y nozzle axes by more than ±0.020 mm.

Figure 6:
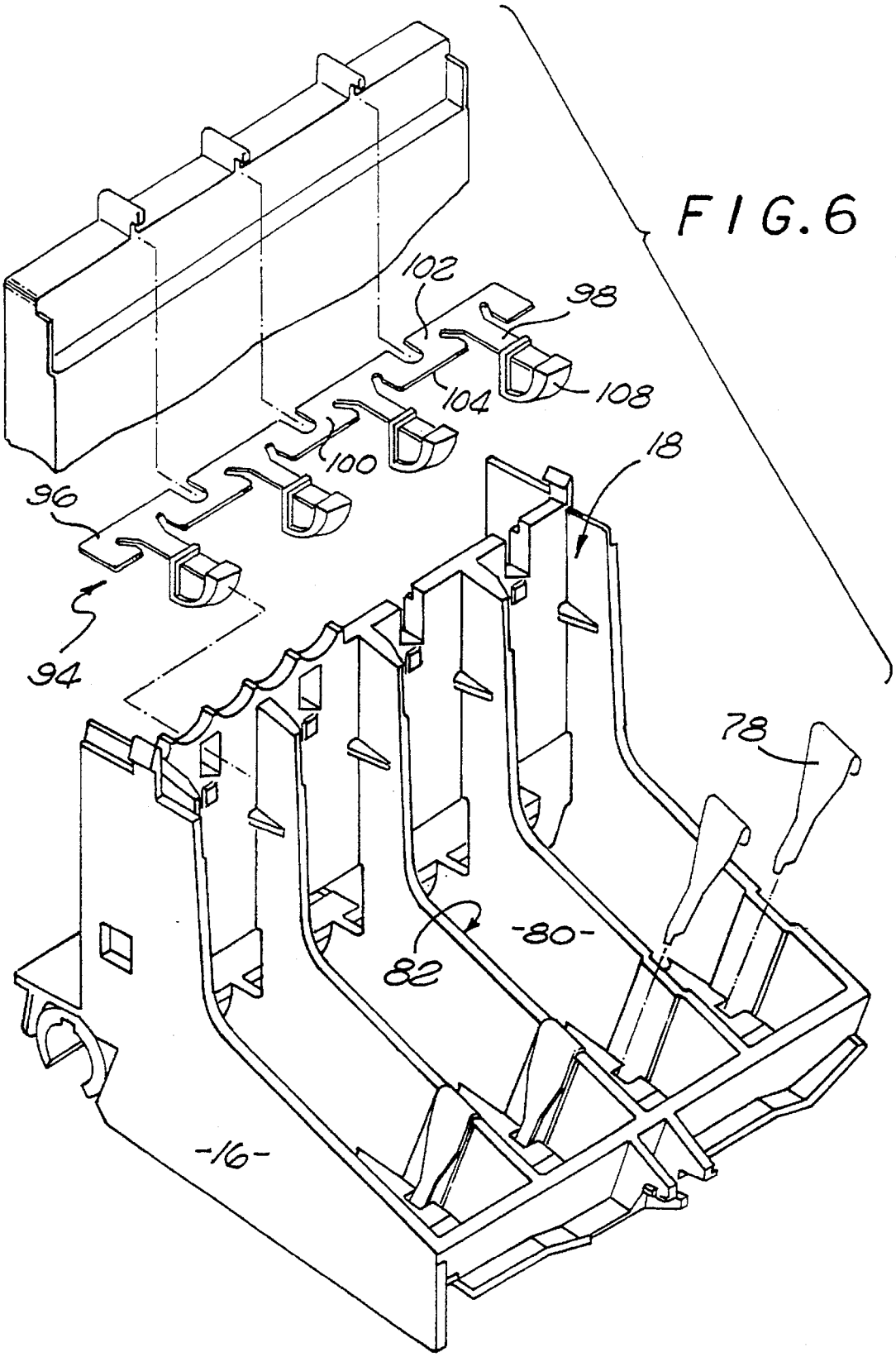
FIG. 6 is an exploded isometric view of the cartridge holder and the various springs which hold the cartridges with their respective datum surfaces in contact with the respective registration features provided in each compartment of the cartridge holder.
Figure 9:
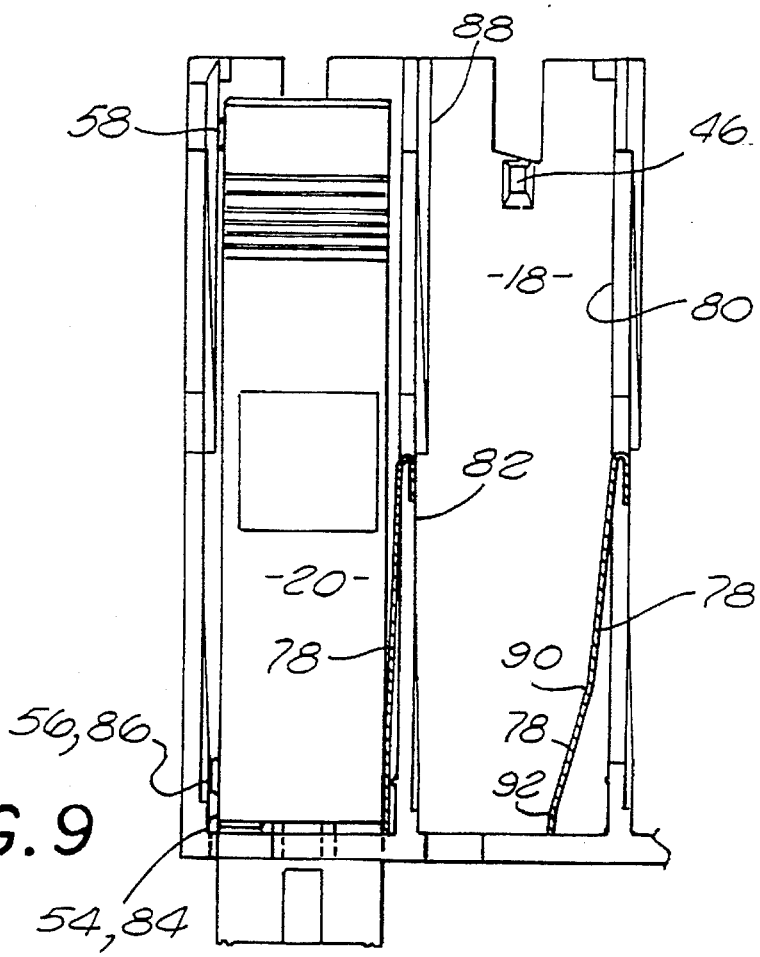
FIG. 9 is a front view, partly in cross section, of respective occupied and empty compartments of the cartridge holder, showing how a relatively thin cantilevered leaf spring provides a sideways bias force in the X axis at the lower end of the cartridge without adding unnecessary width to the cartridge holder.
Figure 10A:
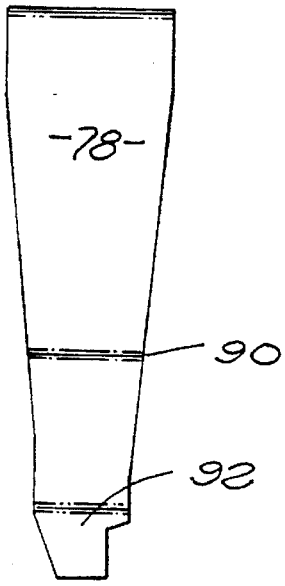
FIGS. 10A and 10B are respective side and front views of the leaf spring of FIG. 9.
Figure 10B:
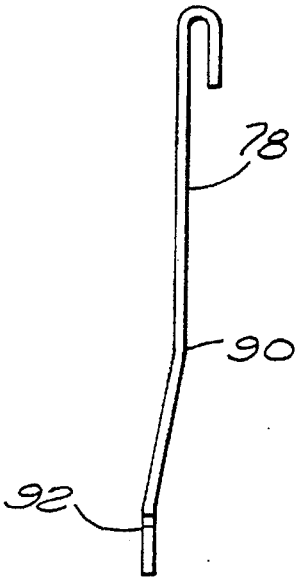
Figure 1:
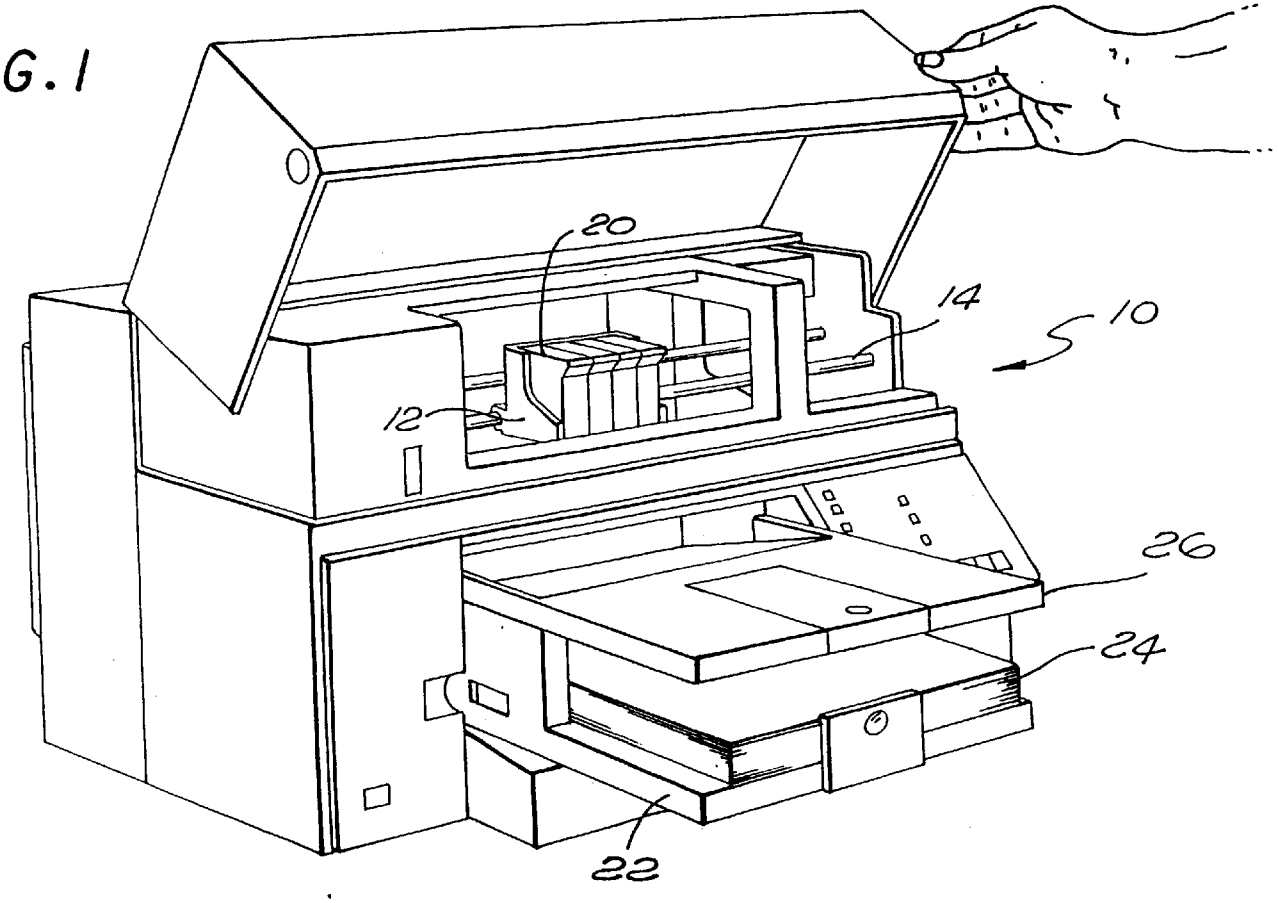

FIG. 6 is an exploded isometric view of the cartridge holder 16 and the various springs which hold the cartridges with their respective datum surfaces in contact with the respective registration features provided in each compartment of the cartridge holder. In particular it will be seen that a downwardly projected cantilevered leaf spring 78 is attached to a sidewall 80 of each cartridge compartment 18 opposite the sidewall 82 (FIG. 9) carrying the three supporting surfaces 84, 86, 88 corresponding to the three datum surfaces 54, 56, 58 (see FIG. 9), which provides the first sideways force X1. Leaf spring 78 is preferably manufactured from spring steel (for example 1050 steel) having a low friction corrosion-resistant coating (for example nickel), to minimize frictional forces between the surface of the spring and the lower edge of cartridge 20 opposite lower datum surfaces 54, 56, which otherwise would generate a countertorque about an axis defined by lower datum surfaces 54, 56 tending to oppose the sideways component X2 and might thus prevent cartridge 20 from assuming its desired orientation relative to the Y-Z plane defined by the three supporting surfaces 84, 86, and 88. As can best be seen in FIGS. 10A and 10B, which comprise respective side and front views of the leaf spring 78, in its uncompressed condition the main portion of leaf spring 78 does not lie flat against sidewall 80, but extends into the interior of compartment 18 at an angle of about 7½° and has a precision bend 90 of about 12° to thereby approximating a circular arc when uncompressed and, when fully compressed, a straight line parallel to sidewall 80 with lower end 92 in contact with the lower end of ink reservoir portion. Leaf spring 78 thus is capable of providing a substantial sideways bias force X1 of approximately 13N at the desired location without adding substantial width to the cartridge holder 16.

The upper portion of FIG. 6 shows a latch assembly 94 for securing all four cartridges 20 inside their respective cartridge compartments 18 of cartridge holder 16. Latch assembly 94 comprises a metallic spring 96 stamped from full hard stainless steel, and comprises four forwardly facing latch ends 98 separated by five respective forwardly facing supporting ends 100. Preferably, each latch end 98 is connected to its two adjacent supporting ends 100 by a serpentine arm 102 defined by suitable radiused cutouts in stamped spring 96 to provide a shape that approximates a constant stress geometry. Each supporting end 100 is terminated by straight edge 104 which is inserted into a corresponding slot 106 (FIG. 7) at the upper rear of cartridge holder 16; because latch assembly 94 is a single unit, only one assembly operation is required for all four cartridge compartments 18. Because of the serpentine shape of the individual serpentine arm 102, it is possible to provide a spring that is relatively compact from front to rear and yet provides a relatively substantial constant force (of approximately 17.3N) over a relatively large deflection range. This compactness contributes in turn to the overall compactness of cartridge holder 16 and thus of inkjet printer 10.

Figure 7:
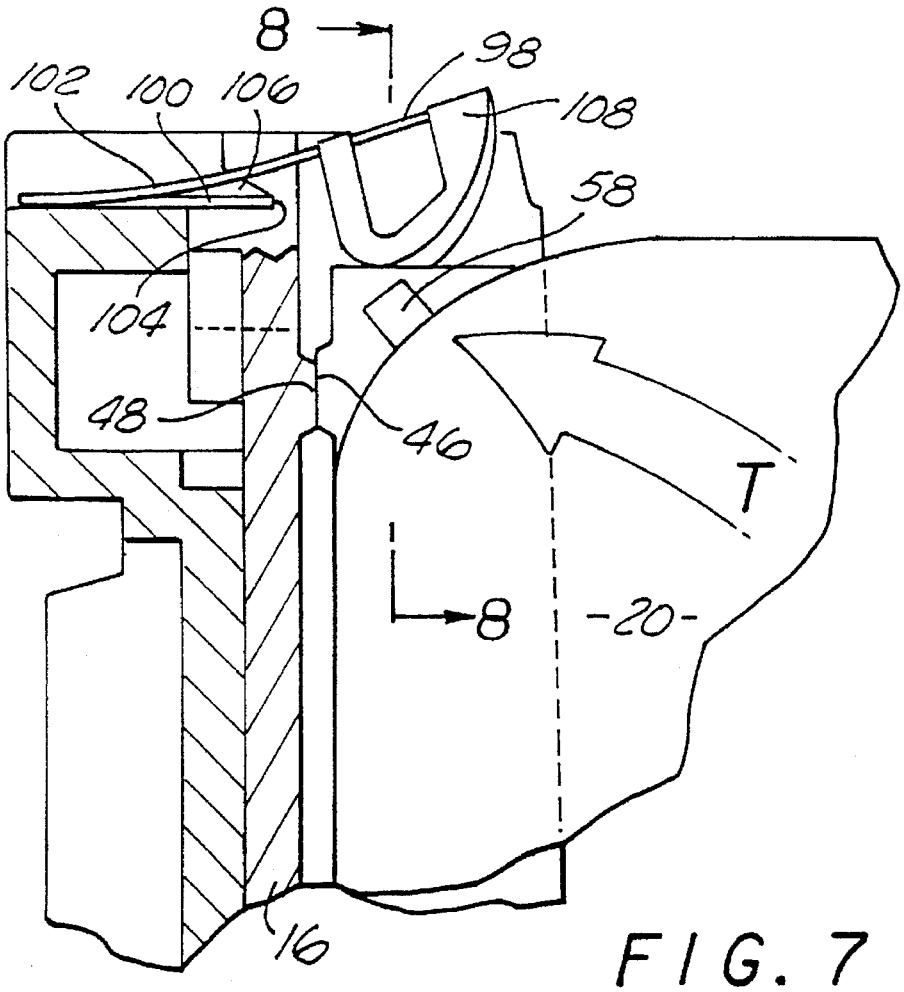
FIG. 7 is a side view, partly in cross section, of the upper rear portion of the cartridge and cartridge holder, showing the cam of the latching spring in contact with a corresponding lip at the top of the cartridge to thereby provide a compound registration force having components in the X and Z axes.

Each latch end 98 is provided with a cam 108 preferably molded of a low friction material such as PTFE filled acetal (in the ratio of 20% PTFE, 80% acetal), which has a coefficient of friction substantially lower than the coefficient of friction of the stainless steel component of the spring. As shown in FIGS. 6, 7 and 8, each molded cam 108 is shaped in the form of a horizontal section of an inclined, sideways oriented cylinder (ie, a cylinder having its axis parallel to the X axis and tilted about the Y axis). As is best shown in FIG. 8, a lower tangential plane formed by the cylindrical surface intersects the plane of the latch end 98 at an oblique angle of about 15.6°, which is complementary to a corresponding oblique surface 112 of a reenforced lip 114 formed on perimeter wall 64 of cartridge 20 between upper rear datum surface 46 and upper side datum surface 58, thereby producing the sideways component X2 of force F, with the low coefficient of the molded plastic material resulting in a greater net sideways force X2 for a given force F.

When a cartridge 20 is inserted into the cartridge compartment 18 (see also FIGS. 2 and 4) the low coefficient of friction of molded cam 108 permits it to slip over oblique surface 112. Thereupon, serpentine arm 102 exerts a downward force Z and sideways force X2 which through the curved surface onto the cartridge. The downward Z force presses the cartridge 20 downward onto the carriage until it contacts horizontal supporting surface 42, while force Y (11N in an exemplary embodiment) produced by electrical interface 52 presses vertical datum surface 44 against vertical supporting surface 45. As noted previously, since the downwards component Z of force F is offset horizontally in the +Y direction from horizontal datum surface 40 and associated supporting surface 42, the resultant counterforce from supporting surface 42 generates a net torque T (FIG. 7) which rotates cartridges 20 about pivot axis P, thereby forcing upper rear datum surface 46 into contact with sixth supporting surface 48, while the sideways bias force X2 presses upper side datum surface 58 against upper side supporting surface 88 (FIG. 8).

It is understood that the above-described embodiment is merely provided to illustrate the principles of the present invention, and that other embodiments may readily be devised using these principles by those skilled in the art without departing from the scope and spirit of the invention.

What is claimed is:

1. An ink-jet hard copy apparatus for applying ink to media passing through a print zone of said apparatus, comprising:

at least one media scanning print cartridge which carries a printhead jetting ink in an axial direction substantially normal to said media;

a carriage having a compartment for holding said print cartridge, said print cartridge having a carriage scan X axis, a media advance Y axis, and the ink jetting direction Z axis;

a unitary spring and a contact member on said spring directly contacting said print cartridge and engages with a single motion to latch fit said print cartridge to said carriage at a top region of said print cartridge distally located with respect to said printhead to provide a positional bias to said print cartridge in each of said X, Y and Z axis; and a biasing member coupled to said carriage and separate from said unitary spring, abutting a side portion of said print cartridge proximate said printhead to provide a positional bias to said print cartridge in said X axis.

2. The apparatus of claim 1 wherein said biasing member comprises:

a leaf spring, having a means at one extremity of said leaf spring for coupling said leaf spring to said carriage and a means at an opposing extremity of said leaf spring for exerting a force on said print cartridge.

3. The apparatus as set forth in claim 2, wherein said leaf spring further comprises:

said means for coupling including a means for cantilevering said spring into said compartment away from said carriage in said X axis at a first predetermined angle;

a central region having a first bend therein at a second predetermined angle away from said carriage in said X axis; and a bottom region, distal from said one extremity, having a second bend therein at a third predetermined angle toward said carriage in said X axis.

4. A method of installing at least one print cartridge in an ink-jet hard copy apparatus media scanning carriage, wherein a printhead is carried on an extremity region of the print cartridge located for applying ink to media passing through a print zone of said apparatus, comprising the steps of:

inserting the print cartridge into a compartment of the carriage to position the printhead adjacent to said print zone;

during said inserting step, contacting a side region of the print cartridge proximate said extremity region of said print cartridge with a spring member to bias the print cartridge in a carriage scan direction; and moving a top end of the print cartridge, distally located from said printhead, forwardly to contact said cartridge with a latching device, said moving step occurring after said inserting step and after said contacting step.

5. The method of claim 4 wherein said moving step further comprises:

applying biasing force with said latching device in a carriage scan direction.

6. The method of claim 4 wherein said moving step further comprises:

applying biasing force with said latching device in an ink firing direction.

7. The method of claim 4 wherein said moving step further comprises:

applying biasing force with said latching device in a media advance axis.

8. An ink-jet hard copy apparatus for applying ink to media passing through a print zone, comprising:

a plurality of print cartridges for respectively containing different color inks therein, each of said print cartridges having a printhead at one extremity region thereon, respectively;

a carriage having a plurality of compartments for holding a print cartridge within each of said compartments such that each printhead is adjacent said print zone;

a unitary latching device on said carriage engaging each of said print cartridges with a single motion to latch fit said print cartridges to said carriage at an extremity region of said print cartridges distal of said one extremity region, respectively, to provide a positional bias to said print cartridges in a carriage scan direction, a media advance direction, and an ink jet ink firing direction; and a plurality of biasing members, one each located within each of said compartments and mounted on said carriage contacting a side portion of each of said print cartridges, respectively, to provide a positional bias to each of said print cartridges, respectively, in the carriage scan direction.

9. The apparatus of claim 8 wherein said unitary latching device includes a unitary metal spring and a plurality of cams coupled upon said metal spring, one for each of said print cartridges, respectively.

10. The apparatus of claim 8 wherein said biasing member includes a separate leaf spring for each print cartridge, each said leaf spring having a means for coupling said leaf spring to said carriage at one extremity thereof and a means for exerting a force on said print cartridge having at least a section of an opposing extremity obliquely located relative to said one extremity.

11. The apparatus as set forth in claim 10, wherein said each of said leaf springs further comprises:

said means for coupling including a means for cantilevering said spring into said compartment away from said carriage in said X axis at a first predetermined angle;

a central region having a first bend therein at a second predetermined angle away from said carriage in said X axis; and a bottom region, distal from said one extremity, having a second bend therein at a third predetermined angle toward said carriage in said X axis.

* * * * *

UNITED STATES PATENT AND TRADEMARK OFFICE

CERTIFICATE OF CORRECTION

PATENT NO : 5,642,143

DATED : June 24, 1997

INVENTOR(S) : W. Wistar Rhoads

It is certified that error appears in the above-identified patent and that said Letters Patent is hereby corrected as shown below:

At Column 3, line 9, delete "inkier" and insert in lieu thereof --inkjet--.

At Column 7, line 16, Claim 6, after "with said" and insert --second spring member--.

Signed and Sealed this

Twenty-fourth Day of March, 1998

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,642,143
DATED : June 24, 1997
INVENTOR(S) : W. Wistar Rhoads

It is certified that error appears in the above-identified patent and that said Letters Patent is hereby corrected as shown below:

Drawings,
Sheet 1 of 9, (containing Fig. 1, Fig. 2 and Fig. 3) should be replaced by Sheet 1 of 9 (containing Fig. 1) as shown in the attached drawing.
Sheet 2 of 9 the label for the Figure at the top of the page has been omitted. It should read -- Fig. 2A --

Signed and Sealed this

Twenty-first Day of October, 2003

JAMES E. ROGAN
*Director of the United States Patent and Trademark Office*